US008910901B2

(12) United States Patent
Denis et al.

(10) Patent No.: US 8,910,901 B2
(45) Date of Patent: Dec. 16, 2014

(54) CENTRALLY-HOLED PAPER ROLL WITH REINFORCING ELEMENT AND METHOD OF MANUFACTURING SAID ROLL

(71) Applicant: SCA Tissue France, Hauts de Seine (FR)

(72) Inventors: Yves Denis, Zimmerbach (FR); Rene Sigwalt, Kunheim (FR); Pierre Laurent, Turckheim (FR); Remy Ruppel, Durrenentzen (FR)

(73) Assignee: SCA Tissue France, Saint-Ouen (FR)

( * ) Notice: Subject to any disclaimer, the term of this patent is extended or adjusted under 35 U.S.C. 154(b) by 0 days.

(21) Appl. No.: 14/012,215

(22) Filed: Aug. 28, 2013

(65) Prior Publication Data

US 2013/0341450 A1 Dec. 26, 2013

Related U.S. Application Data

(62) Division of application No. 12/866,142, filed as application No. PCT/FR2009/000119 on Feb. 3, 2009.

(30) Foreign Application Priority Data

Feb. 4, 2008 (FR) ..... 08 00581
Nov. 17, 2008 (FR) ..... 08 06423

(51) Int. Cl.

| | |
|---|---|
| ***B65H 75/30*** | (2006.01) |
| ***B65H 18/28*** | (2006.01) |
| ***B65H 75/00*** | (2006.01) |
| ***A47K 10/16*** | (2006.01) |
| ***B65H 75/18*** | (2006.01) |

(52) U.S. Cl.

CPC ..... *A47K 10/16* (2013.01); *B65H 2301/41484* (2013.01); *B65H 2301/415016* (2013.01); *B65H 18/28* (2013.01); *B65H 75/00* (2013.01); *B65H 75/18* (2013.01)

USPC ..... 242/612; 242/613.4

(58) Field of Classification Search

USPC ..... 242/160.1, 160.2, 160.4, 525, 532.3, 242/611, 611.1, 612, 613, 613.4

See application file for complete search history.

(56) References Cited

U.S. PATENT DOCUMENTS

2003/0122008 A1 7/2003 Abba et al.

FOREIGN PATENT DOCUMENTS

| | | |
|---|---|---|
| DE | 19946272 | 3/2001 |
| GB | 2390357 | 1/2004 |
| JP | 2000177894 | 6/2000 |
| WO | WO-2005005295 | 1/2005 |

OTHER PUBLICATIONS

France Search Report for French Patent Application No. 0800581; file date Feb. 4, 2008, 2 pages.

PCT International Search Report and Written Opinion for PCT International Application No. PCT/FR2009/000119; PCT International Filing Date: Feb. 3, 2009; 18 pages.

*Primary Examiner* — William E Dondero

(74) *Attorney, Agent, or Firm* — Drinker Biddle & Reath LLP

(57) ABSTRACT

A roll of sheet product, in particular of tissue paper, with a central hole along its winding axis includes a cylindrical reinforcing element onto which the paper is wound. The reinforcing element includes at least one ring joined to the innermost turn of the roll, with a width less than the width of the roll and provided with a means of extracting the ring by pulling substantially along the axis of the roll.

13 Claims, 5 Drawing Sheets

CENTRALLY-HOLED PAPER ROLL WITH REINFORCING ELEMENT AND METHOD OF MANUFACTURING SAID ROLL

CROSS-REFERENCE TO RELATED APPLICATIONS

This application is a division of U.S. application Ser. No. 12/866,142, filed on Aug. 4, 2010, the entire content of which is incorporated herein by reference. U.S. application Ser. No. 12/866,142 is a section 371 Application of International Application No. PCT/FR2009/000119, filed on Feb. 3, 2009, which claims the benefit of French Application No. 0800581, filed on Feb. 4, 2008 and French Application No. 0806423, filed on Nov. 17, 2008.

BACKGROUND OF THE INVENTION

The present invention relates to the field of rolls of tissue paper or other, similar, material such as nonwovens. It relates in particular to the field of products for sanitary and/or domestic use such as, for example, rolls of wiping paper, paper towelling or bathroom tissue.

The term "tissue paper" should be understood to mean a paper with characteristics as defined by the European standard EN 12625-1.

A roll is formed by winding a continuous sheet which consists of one or more plies of paper. The sheet is possibly pre-cut into consecutive segments in the winding direction, and is wound, preferably, about an axis or a spindle that may or may not support a core; the roll can thus comprise a central core or not According to the applications, the roll is unwound, either from its outer surface in the direction of winding perpendicularly to its axis, in which case the unwinding is said to be tangential, or via the interior, from the center in its axial direction. In the latter case, the roll is said to be centrally unwound.

The present invention relates to rolls, that have a central hole, centrally unwound, and rolls with tangential unwinding.

When the roll is intended for an application of the type with central unwinding, it can include a core. The core is a cylinder of cardboard that extends over the width of the roll. It generally comprises a strip of cardboard wound in a helical spiral. In this case, it is essential to begin by extracting the latter when putting the roll to use. For example, the core can be designed so as to be able to be torn when pulled on its edge at one end of the helical spiral of cardboard of which it is formed. However, practice shows that this solution is not always satisfactory, because extracting the core can sometimes prove difficult if the rupture area or areas are malformed. Furthermore, the first sheets of the roll may be dragged out, making them difficult to use. The first turns of the sheet are more often than not glued to the core, so they are unfit for any use and constitute waste.

This type of core is costly to produce, since it generally consists of two or more layers of cardboard bonded by gluing and is associated with glue for "attaching" the first turn of the roll. It is also useless once removed, and therefore becomes waste.

To overcome this drawback, there have also been proposed, according to the prior art, rolls with central unwinding but coreless. These are a priori easier to implement by the user, because there is no longer a need to remove a core before putting them to use. To produce them, it is possible, during manufacture, to provide a provisional core forming a spindle onto which the sheet is wound. The spindle is then removed, before the rolls are packaged. This technique presents constraints on the industrial level, because a station for extracting the spindles must be added to the winding line.

According to a known method of manufacture without core, the sheet is cut in line in the running direction of the latter or longitudinally, before winding on the spindle, from a very wide mother sheet, into as many strips as there are individual rolls to be obtained.

According to another method of manufacture, the mother sheet is wound directly onto a spindle, also without the insertion of a core. The initial sheet which is very wide, is first wound in such a way as to form a single reel with the final diameter of the individual roll, called "log" in the field. When formed, the log is extracted from the spindle and it is cut into individual rolls However, the sheet, whether it be of tissue, creped dry or wet, dry-laid paper or a nonwoven, has a certain elasticity. Because of the internal stresses of the roll, due, for example, to the clamping of the sheet onto the spindle during winding, and/or to the tension of the sheet generated by the machine unwinding/winding operation, it is normally not possible to avoid reduction of the diameter of the central hole by sagging or collapse at the center of the first turns after the spindle has been removed. This collapse is produced, for example, after extraction of the spindle or when the log is cut, by the pressure exerted by the saw or even in packaging and overpackaging operations.

A partial or total reduction of the central hole is observed during handling and transportation operations, because of the inevitable vibrations and pressures to which the rolls are subjected.

When the central hole is completely reduced, it is difficult to reform it by hand, and it is no longer easy to grasp the first turn. Waste is inevitably produced, in particular when the roll is put to use in a dispenser, because it is then necessary to grasp several turns at a time.

Also known are coreless rolls, the central hole of which remains formed after extraction of the spindle and/or after cutting by a saw. It is possible, for example, to use a spindle with a splined or polygonal-section profile to form a central hole, the walls of which are self-supporting. One exemplary embodiment is illustrated by patent FR 2 554 799.

If the central hole is of small diameter, the first turns remain difficult to access. The leader takes the form of a tight bundle, helical with small pitch, that does not lend itself to easy extraction.

If the diameter of the central hole is larger, the first turns must be joined together. For this, a bonding agent is applied that is deposited directly onto the sheet or indirectly via the spindle onto the winding cylinders, by an appropriate system, when the first turns are wound onto the spindle. Any other principle of joining the first turns together, by a mechanical method in particular, can be applied. These first turns are thus consolidated, and together they withstand the forces of the internal stresses.

However, once again, waste cannot be avoided when putting such a roll to use. Whether in the case of a direct use or in the case where this roll were to be used in a dispenser with central unwinding in which the end of the sheet must be inserted into a relatively narrow dispensing orifice, the first turns joined together must first be eliminated.

In the latter type of embodiment, it is impossible to avoid, for certain rolls, the sagging of the central hole, as in the cases mentioned above, because of impacts in transportation. To avoid this risk, provision is also made to preferably package the rolls in cardboard cases, unlike the rolls with core for which a flexible jacket of paper or plastic material is sufficient. The cost is thereby increased.

The benefit that could be obtained from these coreless rolls compared to the rolls with core is thus diminished.

The applicant has developed a coreless roll, said to be with central unwinding, comprising an unwinding leader that is central in relation to its axis, designed to facilitate the grasping of the innermost turns of the roll. This technique is described in the patent applications FR 2 869 891 and EP 1 636 123. It is a specific solution to the problem of collapse of the central hole of coreless rolls.

The present invention provides a different and inventive solution to this same problem and is applicable not only to rolls said to be with central unwinding, but also to rolls with tangential unwinding.

BRIEF SUMMARY OF THE INVENTION

An embodiment of the present invention relates to a roll of paper, in particular of tissue paper, comprising a central hole along its winding axis with a cylindrical reinforcing element on which the paper is wound, wherein said reinforcing element comprises at least one ring attached to the innermost turn of the roll, the ring being of a width less than the width of the roll and provided with a means of extracting the ring by pulling substantially along the axis of the roll.

The rings provide a support for the hole from its manufacture and through to final use, with little additional material compared to a coreless roll and without particular reinforcement.

According to one embodiment the ring includes at least one slot that makes it possible, from the outer edge of the ring, to fold the material forming the ring towards the axis of the roll and so provide a tab forming said extraction means More particularly, the slot follows the curvature of the ring and is in particular in arc-of-circle form. The slot is preferably perpendicular to the axis of the ring. The extraction means is formed from the portion in arc-of-circle form folded back inwards which extends from the axial edge of the ring.

According to a variant, the slot is axial. Preferably the slot extends from an edge of the ring over a part of the width of the ring. The extraction means is formed from the part of the ring that is folded back towards the axis of the roll.

Advantageously, the roll comprises two or more slots making it possible to increase the number of grasping means forming the extraction means The ring is preferably made of cardboard, flush with one end of the roll or close to said end.

According to another variant, the ring comprises at least two layers with an outer layer in contact with the sheet of paper and an inner layer towards the axis of the roll, with a means of extracting the inner layer. This embodiment makes it possible to begin more easily to extract the ring when the sheet is clamped onto the ring and exerts a great pressure, the inner layer being subjected to a lesser pressure than the layer directly in contact with the sheet.

According to an embodiment of this variant, the ring is advantageously made of corrugated cardboard with a corrugated layer between two non-corrugated layers or even formed by folds of different basis weights, notably of higher basis weight for the radially internal folds.

According to another embodiment of this variant, the outer layer and the inner layer are glued to one another, a part of the inner layer in contact with the outer layer not being glued to the outer layer and forming the means of extracting the inner layer.

More particularly, the ring comprises at least two layers with an outer layer in contact with the sheet of paper and an inner layer towards the axis of the roll, the two layers being formed by helical turns, the turns of the inner layer partially overlapping and not being linked in the overlap zone. According to a preferred embodiment, the turns of the outer layer and the turns of the inner layer are wound at one and the same winding angle and the turns of the inner layer have a width greater than that of the turns of the outer layer so as to create said overlap. Notably, the turns of the outer layer are adjoining or substantially adjoining; they may not be perfectly adjoining.

According to another variant, the ring has an area deformed by displacement towards the axis of the roll so as to form a lug.

According to another characteristic, the ring is secured by gluing to at least said innermost turn of the roll.

According to a variant, the ring is secured by mechanical bonding to at least said innermost turn of the roll According to another characteristic, the ring presents a width less than half the width of the roll, preferably less than a third of the width of the roll, and more particularly less than a quarter of the width of the roll. The width is preferably at least equal to a seventh of the width.

This dimension reduces the cost of the material compared to a solution with core over the entire width of the roll, while being sufficient to prevent the collapse of the central hole.

Advantageously, at least the ring has a thickness between 0.1 and 4 mm. Depending on the material used, the thickness of the ring wall will be determined to ensure a sufficient resistance to crushing.

When necessary in order to secure the hole, a second ring is placed in the central hole close to the other edge. It can be secured without gluing in the hole in as much as it is not involved in the extraction of the sheet. It can also, in the case of a use with tangential unwinding, form a support bearing on a shaft of the dispenser on which the roll is installed.

The invention also relates to the use of a roll in a paper dispensing system with central unwinding.

One method of manufacturing a roll according to the invention comprises the fitting on a spindle of hoops arranged to, after transverse cutting forming two of said rings, provide an extraction means on each of said rings, the winding of a wide sheet onto the spindle, the extraction of the spindle and the cutting of the log obtained through said hoops so as to obtain rolls with said rings. As appropriate, the hoops are temporarily fixed in rotation and in translation on the spindle, for the time needed to wind the sheet without slipping. Preferably, the hoops are temporarily fixed onto the spindle by a mechanical means, notably by clamping. Another manufacturing method comprises fitting one or more rings in the central hole provided in the roll after the latter has been wound.

For an embodiment with tangential unwinding, the reinforcing element can comprise a first and a second ring, each glued to at least said innermost turn of the roll and each being designed to serve as a rotating support for the roll.

BRIEF DESCRIPTION OF THE DRAWINGS

Other characteristics, details and advantages of the invention will become apparent from the following description, given by way of illustrative wholly nonlimiting example with reference to the appended drawings in which.

DETAILED DESCRIPTION OF THE INVENTION

Figure 1:
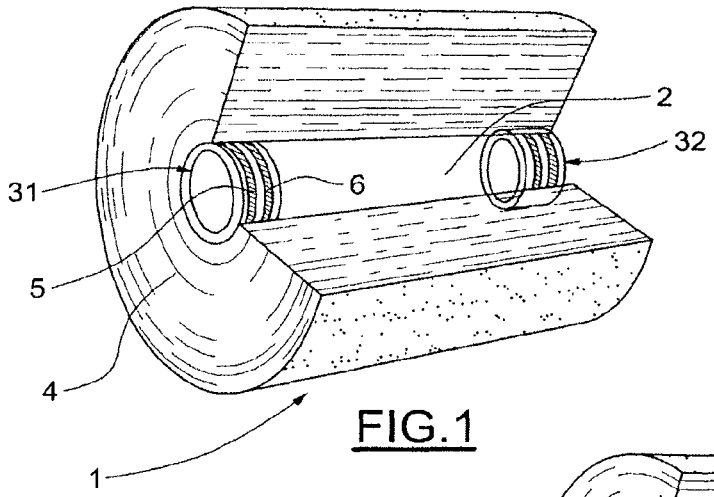
FIG. 1 is a schematic view in perspective of a roll with two rings for a use with tangential unwinding.
Figure 2:
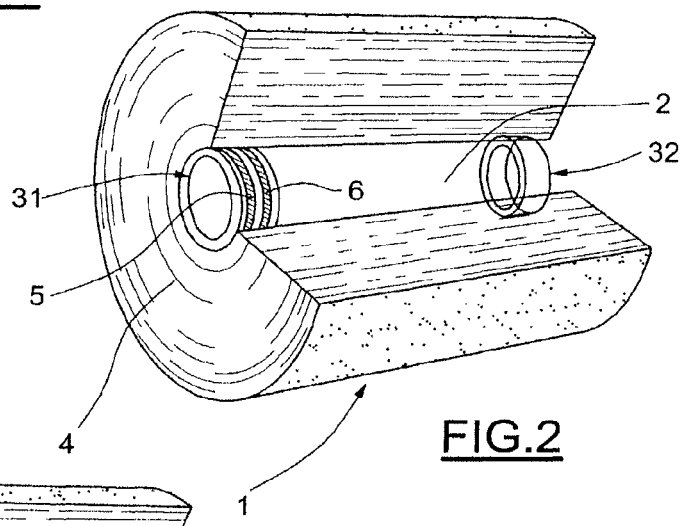
FIG. 2 is a schematic view in perspective of a roll with two rings for central unwinding.
Figure 3:
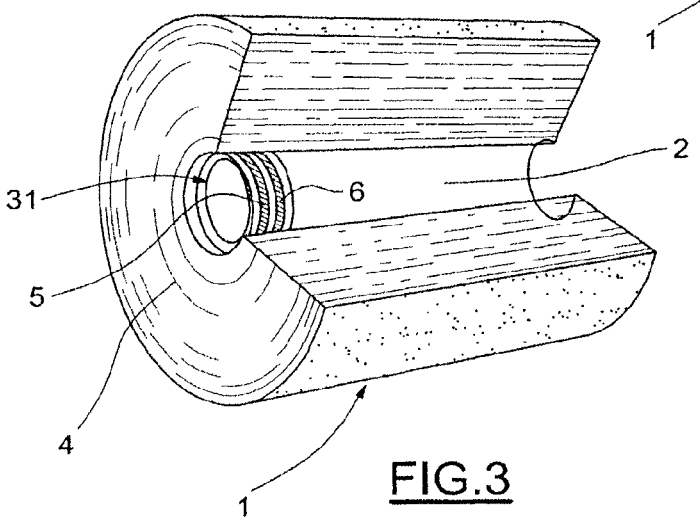
FIG. 3 is another schematic view in perspective of a roll with a single ring.

FIGS. 1 to 3 illustrate embodiments of the roll according to the application filed on Feb. 4, 2008, under registration number FR 0800581 by the applicant, which applicant claims the benefit of priority to and which applicant herein incorporates by reference in its entirety. Applicant also claims the benefit of priority to the application filed on Nov. 17, 2008, under registration number FR 0806423, which is also herein incorporated by reference in its entirety.

The rolled sheet is an absorbent paper for sanitary or domestic use. It is a paper obtained by wet-laid process, creped or not, preferably a tissue paper. It can also be dry-laid paper or even a nonwoven. The embodiment of FIG. 1 illustrates a roll intended in particular for a use with tangential unwinding for which the sheet is unwound from the cylindrical outer surface.

The roll 1 comprises a central void (or hole) 2, cylindrical or substantially cylindrical, generally created on formation of the turns. In the central void 2 there are two rings 31, 32, each close to a flat end 4 of the roll 1 or flush with the latter. The rings 31, 32 are put in place either simultaneously, or after the formation of the roll.

In the embodiments of FIGS. 1-3, the axis of the coreless rolls in fact comprises a sheet of paper wound to its center, with wrinkled turns. This causes a problem of attachment to the shaft of the dispenser, with rotation slowed down or even jammed.

According to this embodiment, the two rings 31, 32 are used as rotational support to the fixed element (shaft) about which the roll can rotate, reduce the friction between these parts, so enhancing the rotation of the roll on its support and therefore the unwinding of the paper from the roll 1. Each of the rings 31, 32 is bonded by gluing its outer surface to the innermost turn of the roll. Two lines of glue 5, 6 are provided on two circumferences of each ring. The bond can also, for example, be produced with spots of glue and/or studs, protuberances that extend beyond outer surface of the ring 31, 32 and attach the first turn or turns. The bond can also be chemical or mechanical.

The width of each ring 31, 32 is in this case substantially the same, in order to best distribute the external forces on each ring. The ring width is less than half the width of the roll, preferably less than a third or even a fifth of that of the roll. For example, it is between 10 mm and 50 mm and more preferably between 15 mm and 25 mm.

Moreover, depending on the nature of the ring material, its thickness is between 0.1 mm and 4 mm.

The two rings 31, 32 are linked to the innermost turns of the roll and serve as support bearing on the fixed element or elements (shafts) that support the roll, ensuring perfect rotation.

According to FIG. 2, two rings 31, 32 are incorporated in the central void (hole) 2. Here, the two rings 31, 32 are not the same: one of the rings, 31, corresponds to the technical description given above in that it is initially totally linked to the inside of the void 2 (for example by lines of glue 5, 6). The second ring 32, positioned close to the second side (not referenced) of the roll 1 has a width less than that of the first ring 31; it is not fixed by gluing or other means to the inside of the void 2, but is simply placed there or pressed in or force fitted. Here, the first ring 31 serves to prevent the collapse of the central void 2, and to extract the innermost turns of the roll 1.

The user grasps the ring 32 (not linked to the first turns), and pulls it axially outward from the roll. This ring 32 is designed to prevent the collapse of the void 2, either when manufacturing the roll or when using it. Then the user grasps the ring 31 and pulls axially outward from the roll, so beginning the first turns and the central unwinding of the roll 1.

An appropriate marking (visual or other) can be provided in order to differentiate the two rings, indicating, for example, that an extraction must be performed on the first ring 31

FIG. 3 illustrates another embodiment that is distinguished from that of FIG. 2 by the absence of the second ring 32. The single ring 31 provided presents the characteristics described above: it is fixed inside the void 2, close to one end 4 of the roll 1. The single ring 31 is sufficient to prevent the collapse of the turns, and this ring can also be used to extract the innermost turns of the roll 1, even if the void on the side opposite to the ring 31 has collapsed or sagged. The embodiment according to FIG. 3, with a single ring 31, can be used for a tangential unwinding in the case where only a single fixed element is provided to support the roll 1.

Whatever the embodiments, the ring or rings 31, 32 consist of a material which is sufficiently resistant not to collapse under the effect of the internal pressure of the roll. A controlled deformation can, however, be exploited to facilitate its extraction as explained hereinbelow. They are preferably made of recyclable material such as cardboard.

According to an embodiment of the present invention, at least one ring is provided with a means to assist with extraction from the central hole when the roll is put to use.

Figure 4:
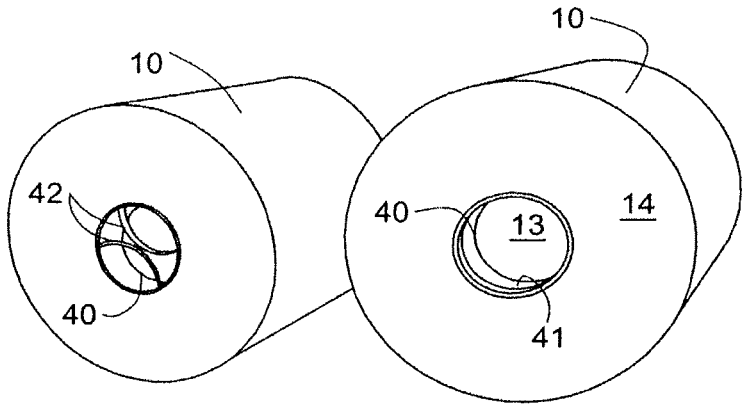
FIG. 4 represents two rolls with an extraction means according to an embodiment of the invention, one in position before putting into use and the other with the extraction means released.

FIG. 4 represents a first embodiment of the extraction means. The cylindrical roll 10 is formed from the winding of a sheet about an axis and comprises a central hole 13 along this axis. A ring 40 is housed in the hole close to the side 14 of the roll. A single ring can be seen. The roll can comprise two. The width of the ring is less than that of the roll. For a roll 100 mm wide, the ring is preferably between 15 and 25 mm wide.

Figure 5:
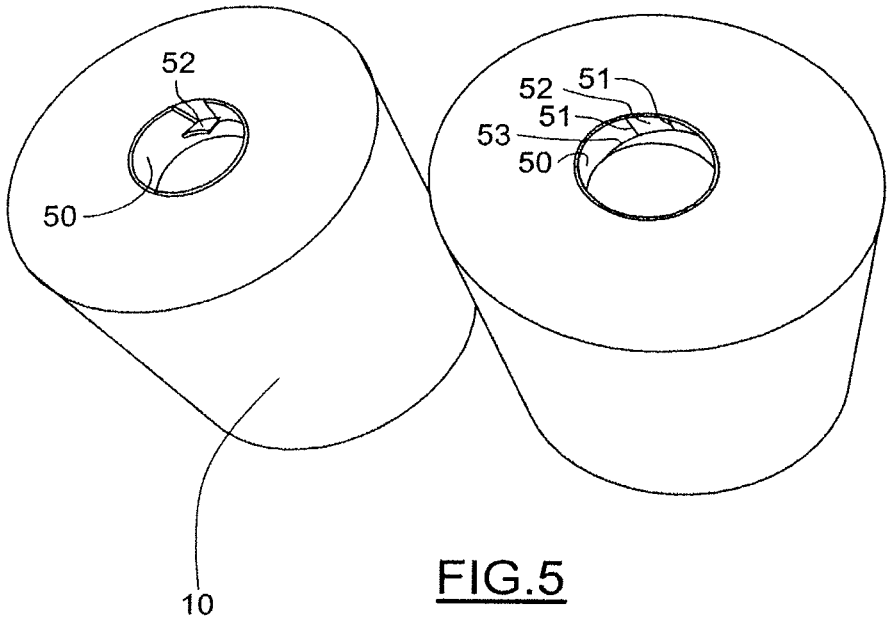
FIG. 5 represents another embodiment of the invention with a ring in which the tabs are released.

An extraction means 42 is formed from a part of the ring, delimited by a slot 41 in arc-of-circle form, in particular parallel to the side 14. The length of the arc-of-circle is less than a half-circumference. The extraction means is freed by deforming this ring part toward the axis of the roll. As can be seen on a roll in the figure, two extraction means 42 have been provided. To extract the ring, the fingers are slipped into the hole and the two means 42 are gripped. An outward pulling force is then exerted, dragging out the ring. If the ring is linked to the innermost sheet of the roll, it is also dragged out. The slot can have any shape along the curved surface of the ring provided it allows a part to be folded toward the center to form a grip for the fingers FIG. 5 represents another embodiment of the extraction means; the roll 10, as previously, comprises at least one ring 50 close to the side 14. This ring 50 comprises at least one axial slot 51 which extends from an edge, the edge situated next to the side 14. It can also be the opposite edge relative to the side 14. The slot extends over a part of the width of the ring.

As can be seen in FIG. 5, the ring here comprises two parallel slots that extend to the spiral junction 53 of the edges of the cardboard strip that has been spiral-wound to form the tube constituting the ring. This allows the slots 51 to be created during manufacture of the tube constituting the ring.

The two slots provide between them a tab 52.

To extract the ring from the central hole, the tab 52 is folded back toward the axis of the roll to release it. This tab is then pulled outward to extract the ring. As in the preceding case, if the sheet is linked to the ring, it is dragged with it.

Figure 6:
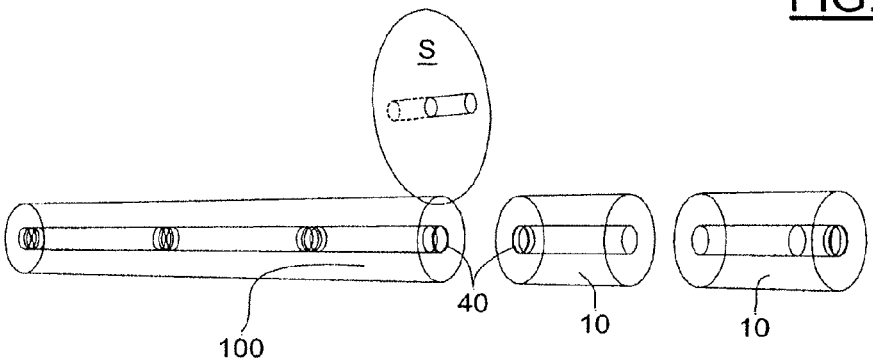
FIG. 6 schematically shows a step in the production of the rolls with formation of a log and its sawing into individual rolls.

These solutions are advantageous when it comes to the production of the rolls because they do not involve substantial modifications. FIG. 6 schematically represents an exemplary manufacturing step. The log 100 has been formed by winding a wide sheet to the required roll diameter, then the log is cut by means of a saw S into individual rolls 10. The sheet has been wound on a spindle that is not represented and, on this spindle, double rings have previously been positioned at regular intervals, each double ring forming a hoop. Advantageously, the hoops are temporarily fixed in rotation and in translation onto the spindle to allow the sheet to be wound onto the spindle and then extracted.

Figure 7:
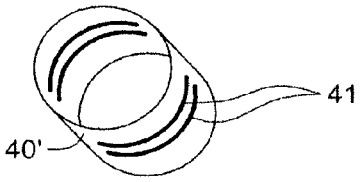
FIG. 7 shows a double ring forming a hoop of the embodiment of FIG. 4.
Figure 8:
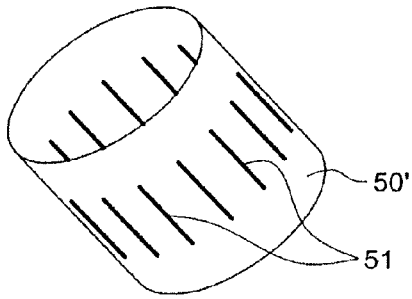
FIG. 8 shows a double ring forming a hoop of the embodiment of FIG. 5.

The hoops are temporarily fixed onto the spindle preferably by a mechanical means, in particular by clamping. The rolls are obtained by sawing the log through the double rings. In FIG. 7, a hoop 40' can be seen with transverse slots 41 in arc-of-circle form. By sawing the hoop 40' between two parallel slots 41, two rings 40 are obtained, one ring for each of two consecutive rolls of the log 100. FIG. 8 shows a hoop 50' with slots 51 parallel to the axis that give two rings 50 after sawing through the slots 51.

Figure 9:
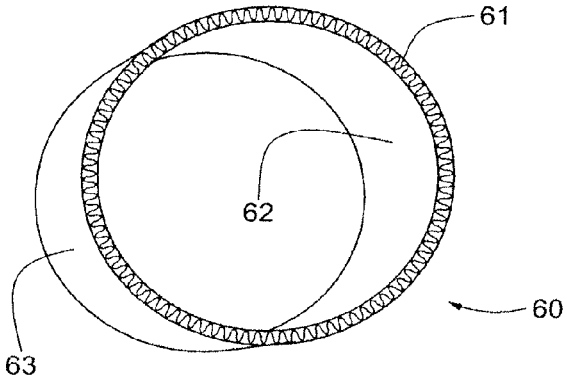
FIG. 9 shows a variant embodiment of the invention with a ring made of corrugated cardboard

FIG. 9 represents another embodiment of the ring with extraction means. The ring 60 is made of corrugated cardboard, a material that is well known per se. The ring thus comprises a corrugated layer 61 between an inner layer 62 and an outer layer 63. The inner layer 62 forms the extraction means of the invention. Thus, when the ring is in place in the central hole of the roll, the corrugated layer supports the pressure forces of the roll, leaving the inner layer 62 subject to a comparatively lesser pressure. Moreover, the inner layer is freed from the internal surface of the roll, so enabling it to be grasped by the fingers.

Figure 10:
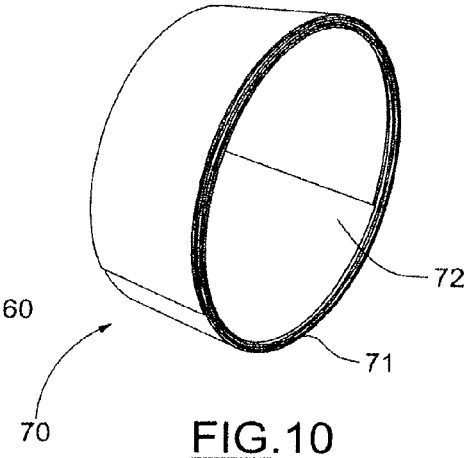
FIG. 10 shows another variant embodiment of the invention with a ring formed by a spiral strip.

FIG. 10 shows another ring variant that can be used in accordance with the invention. In this case, the ring 70 is formed by a spiral winding, with overlapping of the turns 71 over a certain thickness. In this way, as in the preceding case, it is easy to grasp the inner end 72 of the winding.

Figure 11:
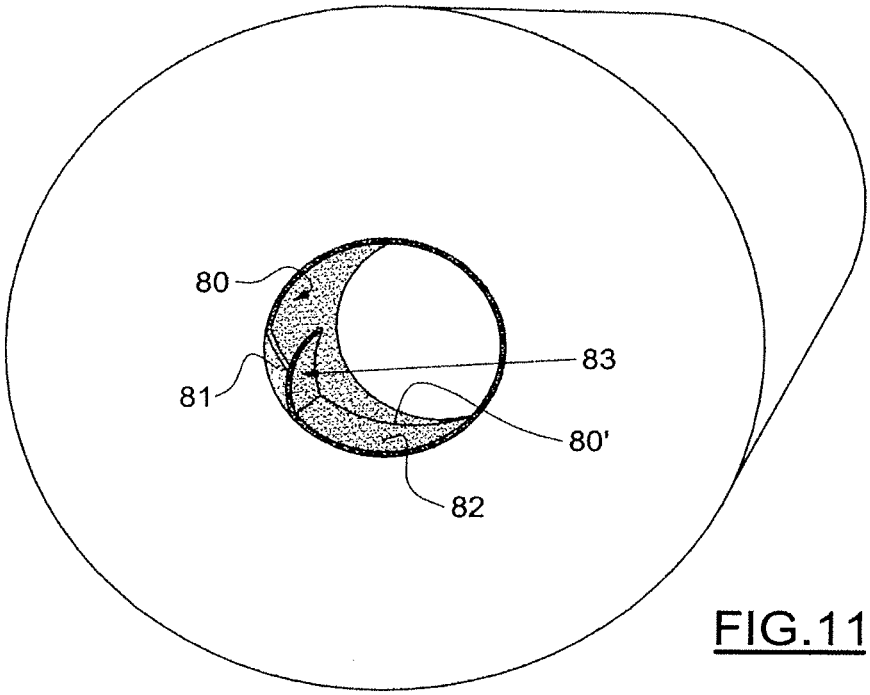
FIG. 11 shows a variant embodiment with a multiple-fold ring.

FIG. 11 represents another embodiment of the invention. The rings 80 inside the central hole of the roll 10 is formed by at least two layers of cardboard. The radially outer layer 81, on the side of the tissue paper, is made of cardboard or craft paper with a relatively light basis weight, of 80 g/m$^2$ to 180 g/m$^2$. The radially internal layer or layers 82 are of a heavier basis weight, 500 g/m$^2$. The ring is produced as a roll core that is known per se. One or more strips forming strands are wound helically around a cylindrical shape. The turns of a strand are adjoining along a helical line 80'. Preferably, the strip with high basis weight is partially glued in order to allow a part of the point of the winding to be freed after saw-cutting. This point 83 advantageously forms a tab for extracting the ring before the roll is put to use.

The detachment of the radially inner layer 82 makes it possible to have the radially outer layer 81 yield by pressure and to release the ring completely. When the latter is extracted, the first sheet of tissue paper glued to the layer 81 is dragged with it.

Figure 13:
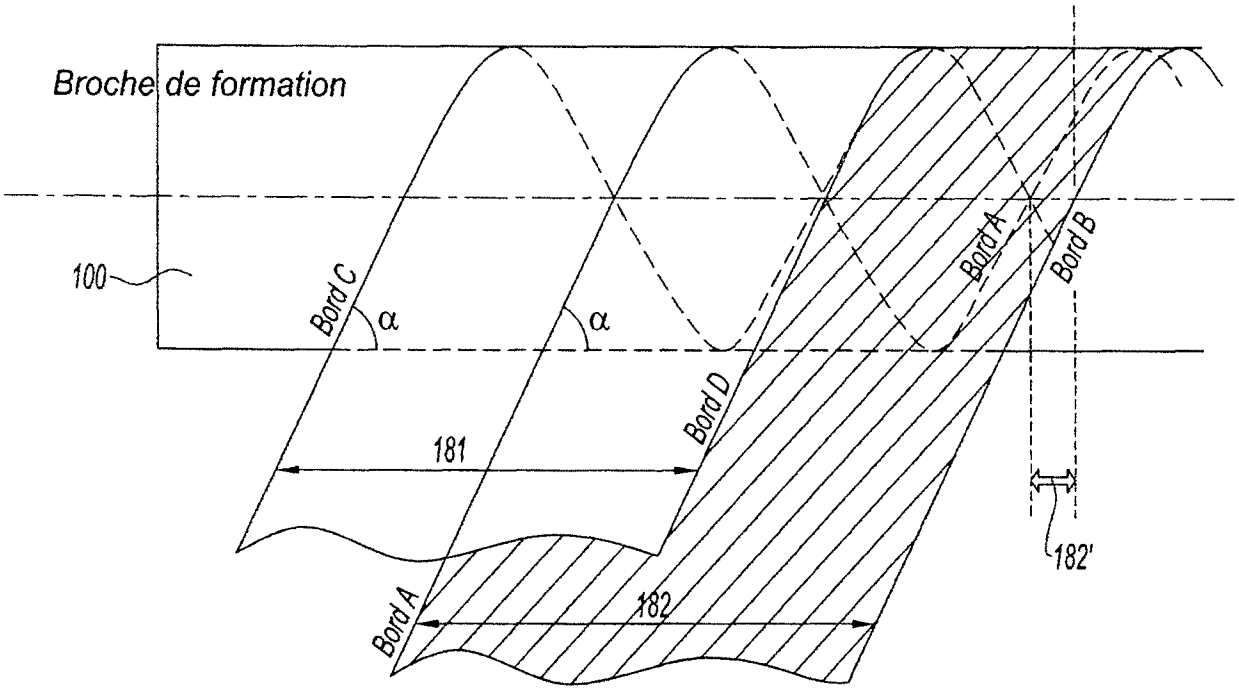
FIG. 13 shows another variant embodiment of the ring with two strips helically wound.

FIG. 13 shows an embodiment of the rings with two stacked layers, one inner 82, the other outer 81. Two strips of cardboard 181 and 182 or other material are wound helically about a cylindrical spindle 100. The angle alpha of the helix relative to the axis of the spindle 100 is the same for both strips. It is selected so that the turns of the outer strip 181 are adjoining or substantially adjoining. The width of the inner strip 182 is greater than that of the outer strip 181. This results in a partial overlap of the turns of the inner strip 182. By gluing the inside of the outer strip 181, the two duly formed layers are secured to each other. However, the overlap area 182' of the turns of the inner strip is not glued. The rings obtained after cutting the tube formed by the two strips exhibit, on the inside, a non-glued part 182'. This part forms the grasping tab. This is one exemplary embodiment of a non-glued area to form a grasping means. This example is not limiting.

Figure 12:
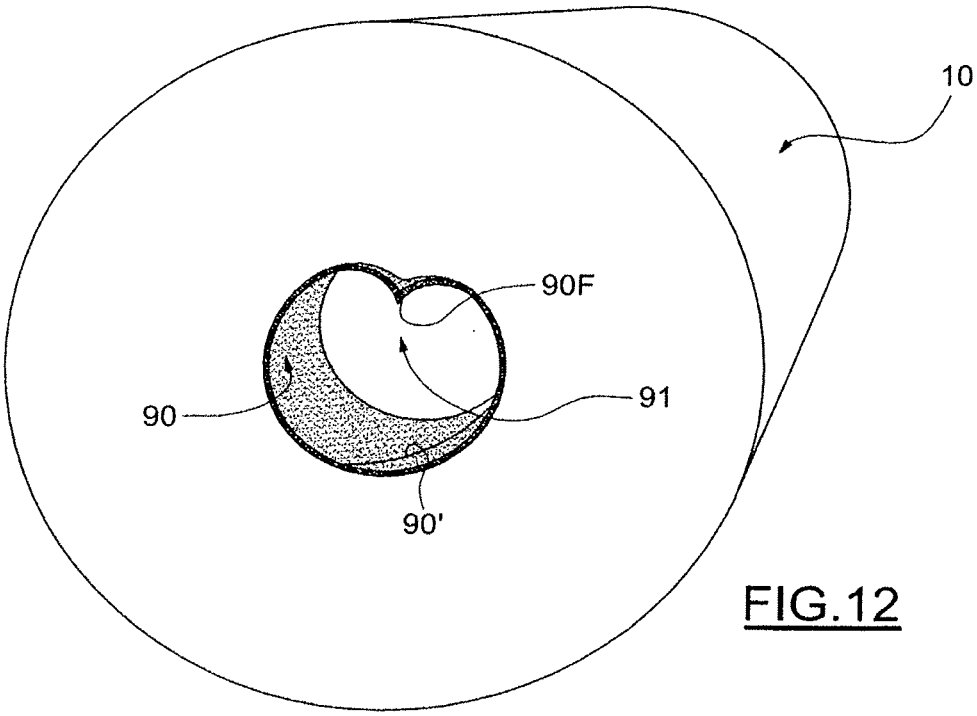
FIG. 12 shows another variant with a ring forming a lug.

In FIG. 12, the embodiment consists of a ring 90 housed in the central hole of the roll 10, on which have been applied axial markings 90F, such as grooves, which, when the roll is cut by sawing, provoke the deformation of the ring 90 under the pressure of the latter. These grooves are parallel to the axis of the roll and preferably formed on the outer face of the ring. The number of grooves is sufficient, six in particular, for the saw to always press close to a marking line regardless of the angular position of the ring. The ring deformed in this way has a point or a lug 91 with an edge formed by the marking 90F providing an easy grip for extraction purposes. The ring 90 is advantageously formed as previously by a spiral-wound, single or multiple strips.

The invention is not limited to the embodiments described, it encompasses all the variants within the scope of those skilled in the art.

The invention claimed is:

1. A roll having a central hole along its winding axis, the roll comprising:

a roll of sheet product; and a cylindrical reinforcing element on which the sheet product is wound, wherein the reinforcing element includes a ring having an outer layer attached to and in contact with an innermost turn of the roll of the sheet product, and having an inner layer towards a winding axis of the roll, the reinforcing element having a means for extracting the ring by pulling substantially along the axis of the roll, the cylindrical reinforcing element having a length in a direction of the axis of the roll less than the length of the roll of sheet product.

2. The roll according to claim 1, wherein the outer layer and the inner layer are glued to one another, a part of the inner layer in contact with the outer layer not being glued to the outer layer and forming the means of extracting the ring.

3. The roll according to claim 1, wherein the inner and the outer layers are formed by helical turns, the turns of the inner layer partially overlapping and not being glued in the overlap area.

4. The roll according to claim 3, wherein the turns of the outer layer and the turns of the inner layer are wound at the same winding angle and the turns of the inner layer have a width greater than that of the turns of the outer layer so as to create said overlap area.

5. The roll according to claim 4, wherein the turns of the outer layer are adjoining.

6. The roll according to claim 1, wherein the ring is secured by gluing or by mechanical bonding to the innermost turn of the roll of sheet product.

7. The roll according to claim 1, wherein the ring has a width less than a third of the width of the roll of sheet product.

8. The roll according to claim 7, wherein the width of the ring is at least equal to a seventh of the width of the roll of sheet product.

9. The roll according to claim 1, wherein the ring comprises a first ring disposed in the central hole and a second ring disposed in the central hole axially offset relative to the first ring, the second ring secured in position without gluing.

10. A roll having a central hole along its winding axis, the roll comprising:

a roll of sheet product; and a cylindrical reinforcing element on which the sheet product is wound, wherein the cylindrical reinforcing element includes a ring having an outer layer attached to and in contact with an innermost turn of the roll of the sheet product, and having an inner layer towards a winding axis of the roll, and wherein the outer layer and the inner layer are glued to each another with a part of the inner layer not being glued to the outer layer to form a portion of the inner layer that is configured to be pulled substantially along the axis of the roll to extract the ring.

11. A roll having a central hole along its winding axis, the roll comprising:

a roll of sheet product; and a cylindrical reinforcing element on which the sheet product is wound, wherein the cylindrical reinforcing element includes a ring having an outer layer attached to and in contact with an innermost turn of the roll of the sheet product, and having an inner layer towards a winding axis of the roll, and wherein the outer layer and the inner layer are formed by helical turns, the helical turns of the inner layer partially overlapping and not being glued in an overlap area to form a portion of the inner layer that is configured to be pulled substantially along the axis of the roll to extract the ring.

12. The roll according to claim 11, wherein the turns of the outer layer and the turns of the inner layer are wound at the same winding angle and the turns of the inner layer have a width greater than that of the turns of the outer layer so as to create said overlap area.

13. The roll according to claim 12, wherein the turns of the outer layer are adjoining.

* * * * *